US006039586A

United States Patent [19]

Kitamura

[11] Patent Number: 6,039,586

[45] **Date of Patent: *Mar. 21, 2000**

[54] LEVER TYPE CONNECTOR

[75] Inventor: Hiroshi Kitamura, Kanagawa, Japan

[73] Assignee: The Whitaker Corporation, Wilmington, Del.

[ * ] Notice: This patent issued on a continued prosecution application filed under 37 CFR 1.53(d), and is subject to the twenty year patent term provisions of 35 U.S.C. 154(a)(2).

[21] Appl. No.: 08/923,221

[22] Filed: Sep. 4, 1997

[30] Foreign Application Priority Data

Sep. 6, 1996 [JP] Japan ..... 8-257637

[51] Int. Cl.[7] ..... H01R 13/62

[52] U.S. Cl. ..... 439/157; 439/152

[58] Field of Search ..... 439/152, 153, 439/157, 160

[56] References Cited

U.S. PATENT DOCUMENTS

| | | | |
|---|---|---|---|
| 5,445,530 | 8/1995 | Inoue et al. | 439/157 |
| 5,463,912 | 11/1995 | Inoue et al. | 439/372 |
| 5,681,175 | 10/1997 | Busse et al. | 439/157 |

*Primary Examiner*—Lincoln Donovan

[57] ABSTRACT

A lever type connector has a lever (60) and a housing body (10) consisting of a main body (20) and a wire cover (40). The lever (60) has a pair of arms (65), and an operating part (66) which connects the arms (65) at one end. When the lever (60) is mounted on the housing body (10), the ribs (43) on the inclined parts (42) of the wire cover (40) engage with the arms (65) and act to spread the arms (65) outward. When the arms in this outward-spread state are moved over the posts (22) so that the arms reach positions directly above the posts (22), the arms undergo elastic recovery inward, and act to move the openings (62) into positions in the vicinity of the posts (22).

11 Claims, 5 Drawing Sheets

LEVER TYPE CONNECTOR

FIELD OF THE INVENTION

The present invention is directed to a lever type connector which is equipped with a lever in order to realize low-insertion-force engagement with a mating connector.

BACKGROUND OF THE INVENTION

Examples of conventional lever type connectors are disclosed in Japanese Patent Application No. 5-129048 and Japanese Utility Model Application No. 6-72173. In these disclosed lever type connectors, the lever is formed as a substantially C-shaped part which has a pair of arms and an operating part which connects these arms at one end. Furthermore, an opening is formed in each of the arms. These openings are engaged with posts formed on the connector housing body; as a result, the lever can pivot about these posts.

However, in the case of the conventional lever type connectors described above, attachment of the lever is difficult. In conventional lever type connectors, it is necessary to align the openings formed in the arms with the posts of the housing body while elastically deforming the arms, and then to engage the openings and posts, by means of a manual operation. As a result, excessive labor is required so that the efficiency of assembly work is poor. Accordingly, the object of the present invention is to provide a lever type connector which is improved so that attachment of the lever can be accomplished easily and securely.

SUMMARY OF THE INVENTION

An electrical connector having a housing body and a lever, the housing having a first connecting member, the lever having a pair of arms connected at one end by an operating part, the lever having a second complementary connecting member so that the lever can pivot about the housing body when the lever is connected to the housing body, the housing having a guide member to engage and align the pair of arms of the lever with the housing body, the guide member guides the pair of arms while opening the pair of arms elastically outwardly until the first connecting member is aligned with the second connecting member, upon alignment of the first connecting member with the second connecting member, the engagement between the guide member and the pair of arms is released causing elastic recovery of the pair of arms inwardly so that the connecting members secures the pair of arms to the housing body.

In one embodiment, openings are formed in the pair of arms, and posts are formed on the housing body. In this case, the guide means includes projecting parts which are formed on the respective arms so that these projections protrude inward, and inclined parts which are formed on the housing body, and which are inclined toward the posts from positions lower than the tip ends of the posts to positions higher than the tip ends of the posts. The projecting parts engage with the inclined parts, and act in conjunction with the inclined parts to guide the arms. The projecting parts may also be step parts formed along the direction of length of the arms. Furthermore, the engagement releasing means includes shoulders which terminate the inclined parts at the ends located adjacent to the posts. These shoulders act to release the engagement between the projecting parts and the inclined parts when the openings in the lever reach positions directly above the posts of the housing body.

Furthermore, the guide means includes a rail means which is used to cause substantially rectilinear movement of the arms. This rail means may be formed in a complementary shape by forming ribs or grooves on the housing and arms. The rail means on the housing body may be formed on the inclined parts.

Also, the inclined parts are formed on a wire cover part. This wire cover part may be formed separately from the main body of the housing body and later attached to this main body, or may be formed as an integral part of the main body of the housing body.

In a further example, the device may be constructed so that the openings are engaged with the posts when the arms are caused to undergo elastic recovery inward.

BRIEF DESCRIPTION OF THE DRAWINGS

A lever type connector of the present invention will be described below with reference to the attached drawings.

DETAILED DESCRIPTION OF AN EMBODIMENT OF THE INVENTION

Figure 1:
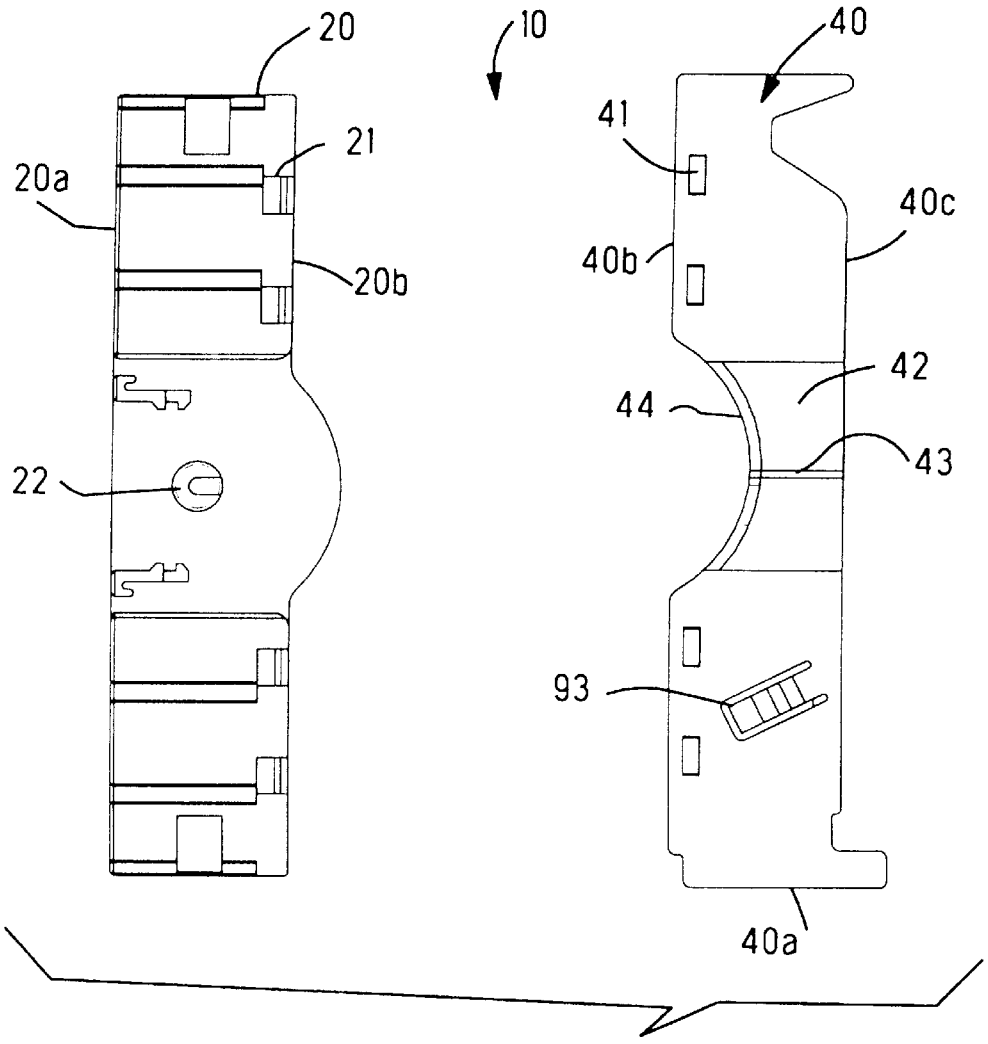
FIG. 1 is a plan view of the main body and wire cover constituting the housing body of the lever type connector.
Figure 2:
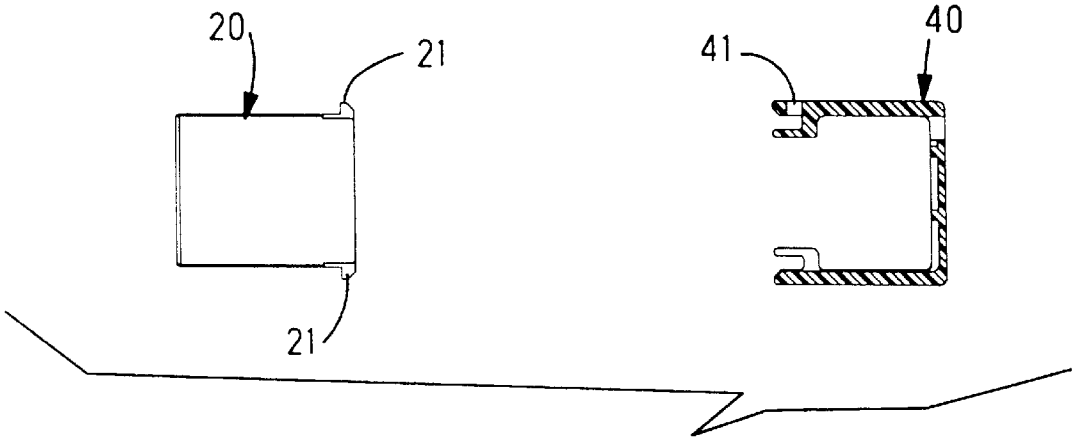
FIG. 2 shows a front view of the main body and a sectional view of the wire cover.

As is shown in FIGS. 1 and 2, the housing body 10 is constructed by assembling the main body 20 and wire cover 40. The wire cover 40 is attached on the side of the rear surface 20*b* of the main body 20, which is located on the opposite side of the main body 20 from the engagement surface 20*a*. Although this is not shown in the drawings, a plurality of contacts terminated in wires are inserted into the main body 20 from the side of the rear surface 20*b*, and these wires extend to the outside from the rear surface 20*b*. The wire cover 40 described above is attached from a point further to the rear than the wires; the wire cover 40 bundles these wires, and guides the wires so that the wires are caused to extend from one side 40*a*. A plurality of engaging projections 21 are disposed on the top and bottom ends of the rear surface 20*b* of the main body 20, and a plurality of engaging holes 41 are formed in the vicinity of the attachment side 40*b* of the wire cover 40 which is attached to the main body 20. The main body 20 and the wire cover 40 are fastened together by the engagement of these engaging projections 21 and engaging holes 41 as shown in FIGS. 3 and 4.

Figure 3:
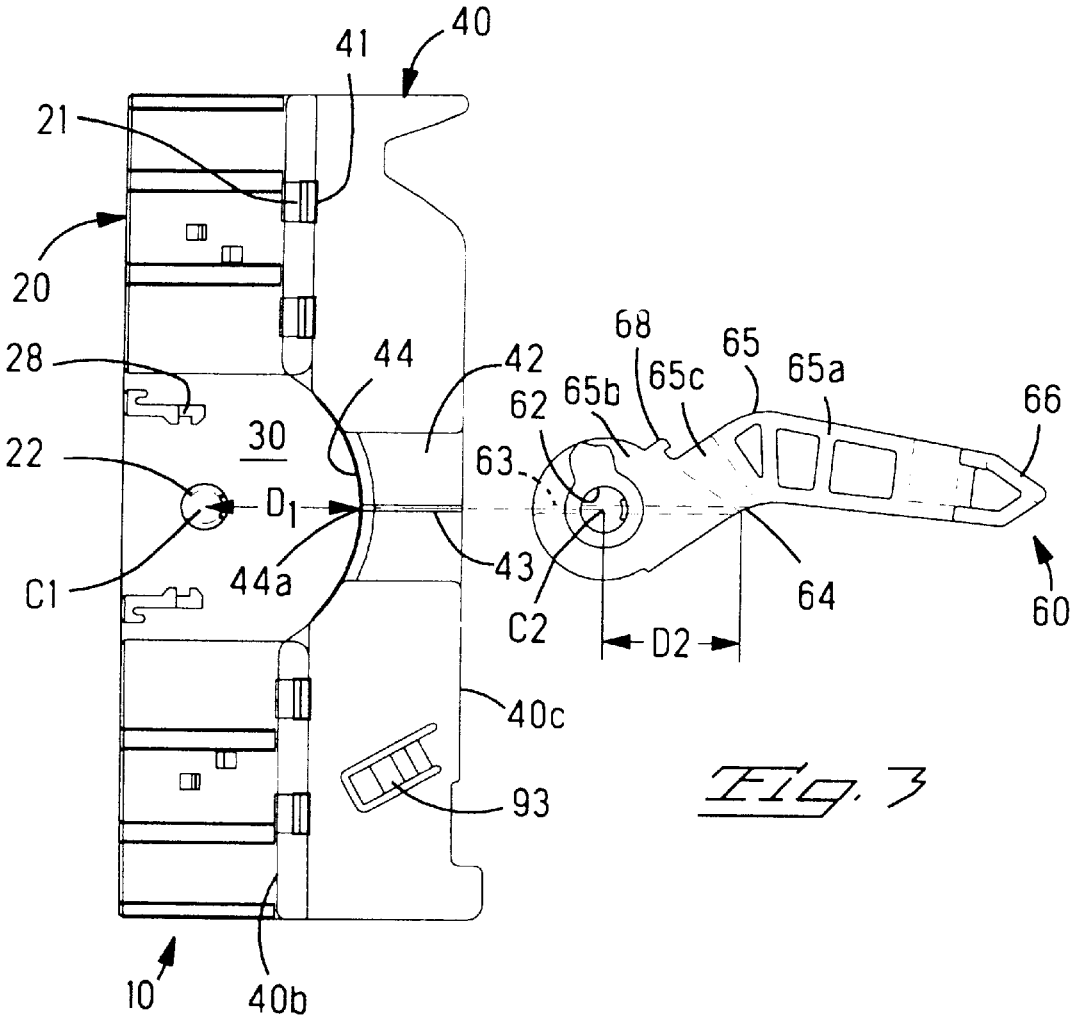
FIG. 3 is a plan view of the housing body and lever.
Figure 4:
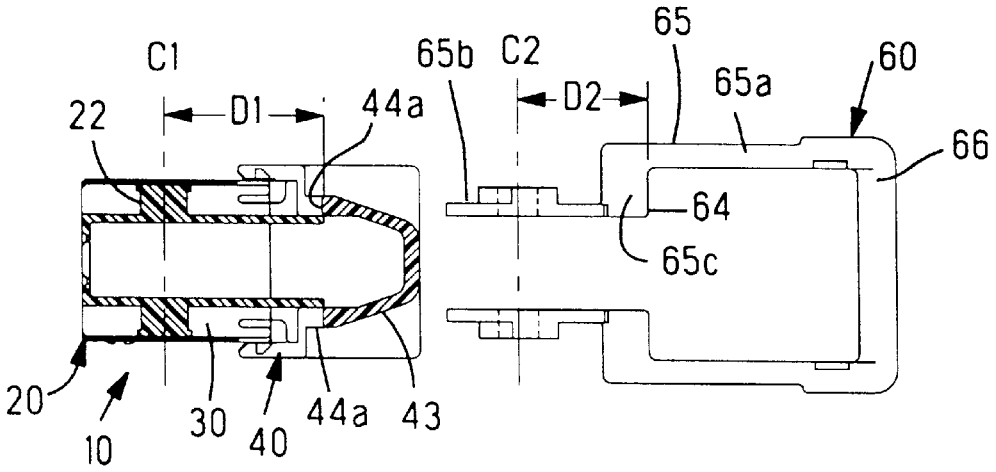
FIG. 4 shows a cross sectional view of the housing body and a front view of the lever.

A lever 60 which is mounted from the rear side of the assembled housing body 10 and wire cover 40 is shown in FIGS. 3 and 4. This lever 60 has a pair of arms 65 and an operating part 66 which connects these arms 65 at one end. Each of the arms 65 has a first part 65*a* which is connected to the operating part 66, and a second part 65*b* which is positioned to the inside of the first part 65*a* via a step part 65*c*. Each second part 65*b* has an opening 62 which engages with a post 22 formed on the main body 20 as a pivoting shaft, and a groove 63 which communicates with the opening 62 and which extends in a substantially rectilinear manner. As is shown in FIG. 3, inclined parts 42 which are inclined outward from the rear side 40*c* toward the attachment side 40*b,* and which have ribs 43 formed in the center, are disposed on the top side and bottom side of the wire cover 40 in positions near the center of the wire cover 40. The inclined parts 42, including the ribs 43, terminate at the attachment side 40*b* of the wire cover 40, and form shoulders 44 which extend substantially in the shape of circular arcs as shown in FIG. 3. As is shown in FIGS. 3 and 4, spaces 30, in which the posts 22 are positioned, are disposed on the main body 20 side of the shoulders 44. The lever 60 is moved in the direction indicated by arrow P (see FIGS. 5 and 6) from the position shown in FIGS. 3 and 4, and is assembled with the housing body 10. What is important from the standpoint of dimensions is that the connector be constructed so that the distance D1 from the centers C1 of the posts 22 to the shoulder parts 44*a* at the center positions where the ribs 43 of the shoulders 44 are disposed be set at a value that is close to but greater than the distance D2 from the centers C2 of the openings 62 in the lever 60 to the rear ends 64 of the second parts 65*b,* and so that portions of the second parts 65*b* overlap with the posts 22 when the ends 64 of the lever 60 are superimposed on the shoulder parts 44*a*. The action resulting from this arrangement will be described below.

Figure 5:
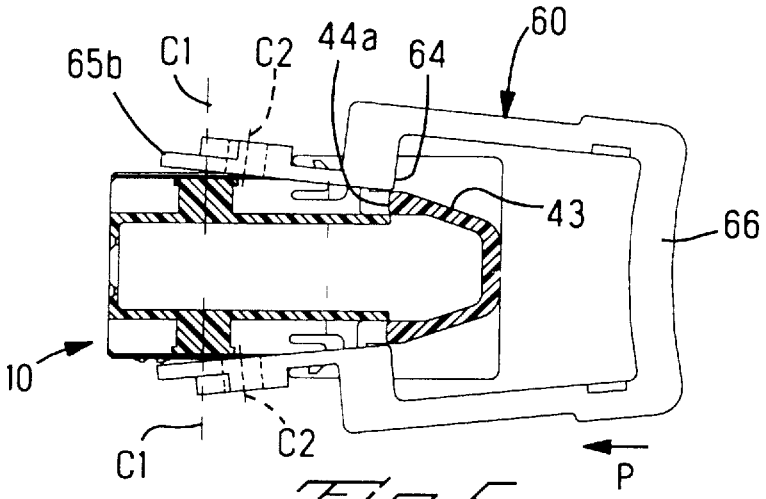
FIG. 5 is a figure similar to FIG. 4 which illustrates an intermediate stage in the assembly of the lever.

FIG. 5 shows an intermediate stage in the attachment of the lever 60. Since the lever 60 is moved in the direction indicated by arrow P in the FIGS. 5 and 6, the second parts 65*b* engage with the ribs 43 of the wire cover 40, and are spread elastically outward. In this case, since the ribs 43 engage with the grooves 63 and guide the movement of the lever 60 in the direction indicated by arrow P, the lever 60 can be smoothly mounted on the housing body 10.

Figure 6:
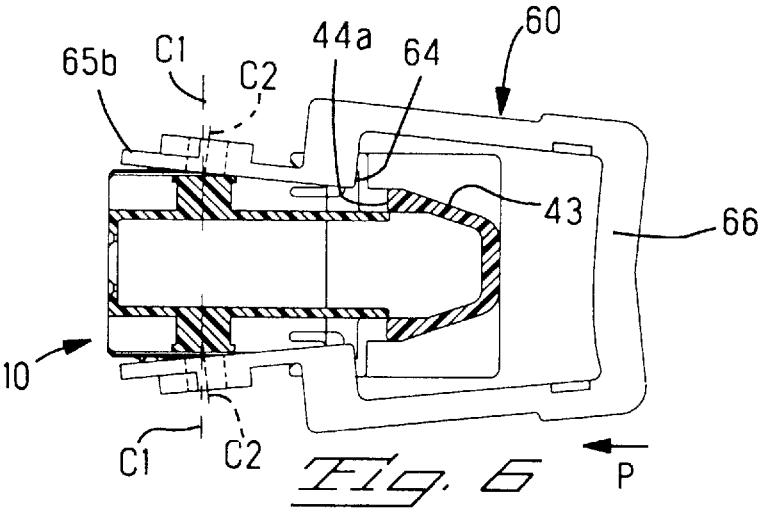
FIG. 6 is a view similar to FIG. 3 which illustrates a stage of assembly more advanced than the stage shown in FIG. 5.

The state in which the arms 65*a* are elastically spread continues until the lever 60 is moved further in the direction indicated by arrow P as shown in FIG. 6 so that the ends 64 of the second parts 65*b* reach the shoulder parts 44*a*. When the ends 64 reach the shoulder parts 44*a,* the engagement between the second parts 65*b* and the ribs 43 of the inclined parts 42 is released, and arms 65 undergo elastic recovery inward. As a result, the second parts 65*b* move onto the posts 22 and contact the upper surfaces of the posts 22. At this time, the openings 62 are positioned in the vicinity of the posts 22. The state of contact between the second parts 65*b* and the posts 22 is shown in FIG. 6.

Figure 7:
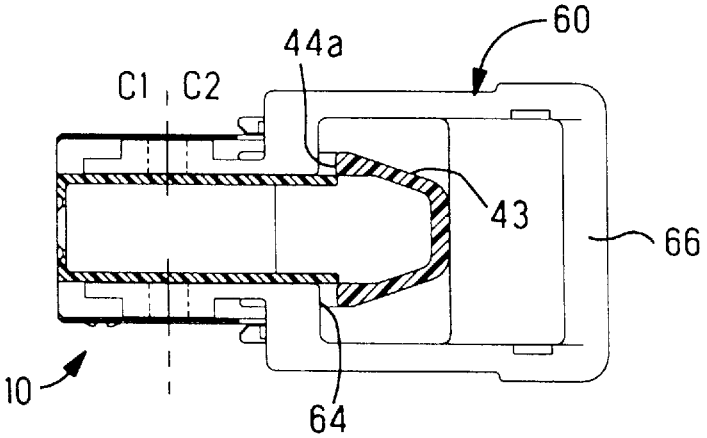
FIG. 7 is a view similar to FIG. 4, and illustrates the completed assembly of the lever.

Afterward, the lever 60 is moved slightly until the centers C2 and C1 of the openings 62 and posts 22 are aligned; then, the openings 62 and posts 22 are engaged, so that assembly is completed as shown in FIG. 7. In the movement performed here, the elastic recovery force of the lever 60 itself acts in an assisting manner so that the lever 60 is pushed toward the engagement surface by the joint action of the lever 60 and the shoulders 44; accordingly, there is no need for a large operating force. Thus, the lever 60 can be smoothly mounted on the housing body 10 merely by pushing the lever 60 inward in the direction indicated by arrow P with the ribs 43 of the inclined parts 42 engaged in the grooves 63. Accordingly, it will be understood that the assembly working characteristics are extremely good.

Figure 8:
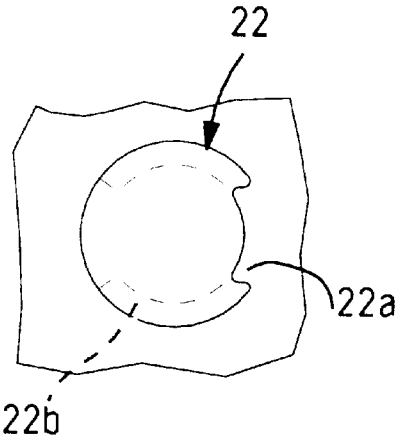
FIG. 8 is a plan view of one of the posts.
Figure 9:
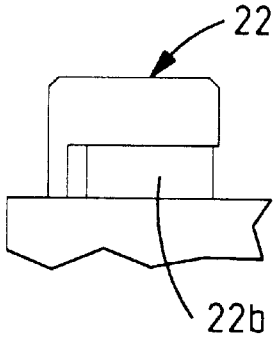
FIG. 9 is a front view of the post.
Figure 10:
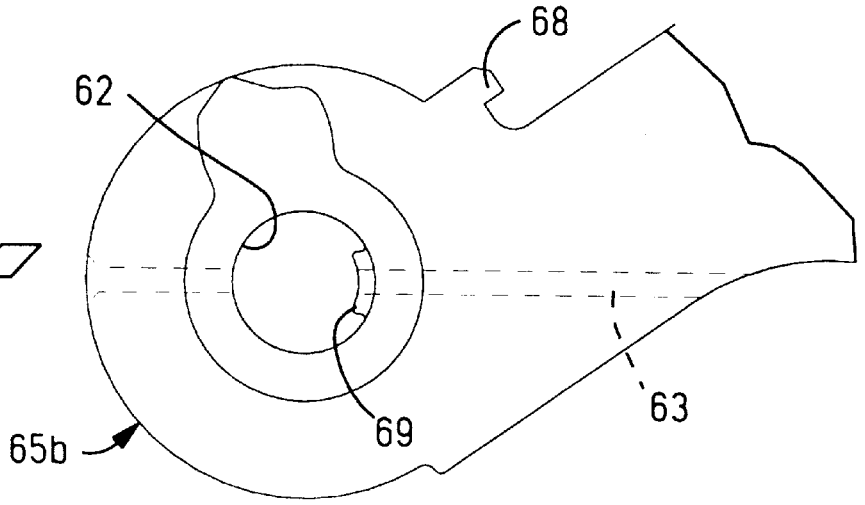
FIG. 10 is a partial enlarged plan view of the vicinity of one of the openings.
Figure 11:
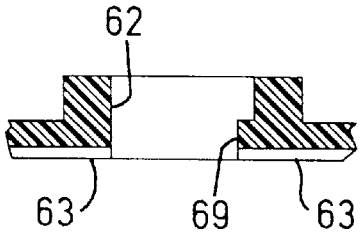
FIG. 11 is a partial cross section along the groove.

FIGS. 8, 9, 10 and 11 respectively show the shapes of the posts 22 and the openings 62. FIG. 8 is a plan view of one of the posts 22, and FIG. 9 is a front view of the same. Furthermore, FIG. 10 is a partial enlarged plan view of the second part 65*b* of one of the arms 65, and FIG. 11 is a partial section along the groove 63 in FIG. 10. The posts 22 and openings 62 are constructed so that mutual engagement is facilitated, and so that this engagement is not released during the pivoting of the lever 60. The construction and action of the posts 22 and openings 62 will be described below.

As is shown in FIGS. 8 and 9, the posts 22 have a substantially cylindrical shape; each post 22 has a recess 22*a* which is formed by cutting away a portion of the post 22 in the circumferential direction as shown in FIG. 8, and a groove 22*b* which is formed along the circumference at the root end of the post 22 as shown in FIG. 9. As shown in FIGS. 8 and 9, the recess 22*a* communicates with the groove 22*b*.

Furthermore, as is shown in FIGS. 10 and 11, the openings 62 have a substantially circular shape, each opening 62 has a projecting part 69. This projecting part has a shape and dimensions which are complementary to those of the recess 22*a* of the corresponding post 22, and is positioned inside the opening 62 toward the bottom of the opening 62.

Especially in the final stage of lever assembly, in which the second parts 65*b* are moved slightly while in a state of contact with the posts 22, the recesses 22*a* and projecting parts 69 are aligned as a result of the engagement of the grooves 63 and the ribs 43. Accordingly, when the posts 22 and openings 62 are engaged, the projecting parts 69 pass through the recesses 22*a* and are positioned at the same height as the grooves 22*b*. Subsequently, when the lever 60 is pivoted relative to the housing body 10, the projecting parts 69 move through the grooves 22*b* away from the positions of the recesses 22; as a result, the arms 65 of the lever 60 are securely fastened to the housing body 10.

Figure 13:
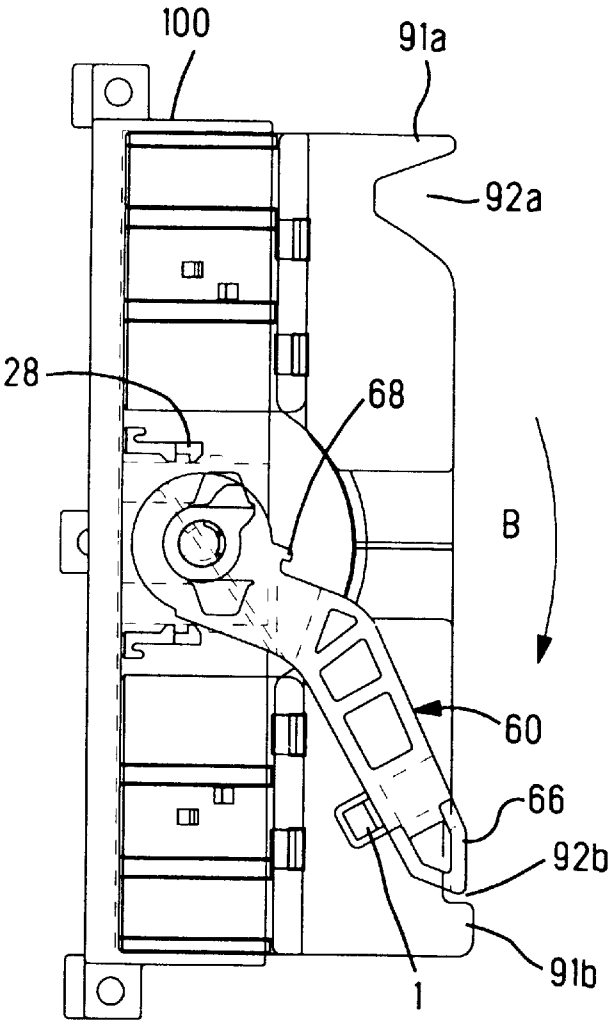
FIG. 13 is a plan view of the lever in the final anchoring position.
Figure 12:
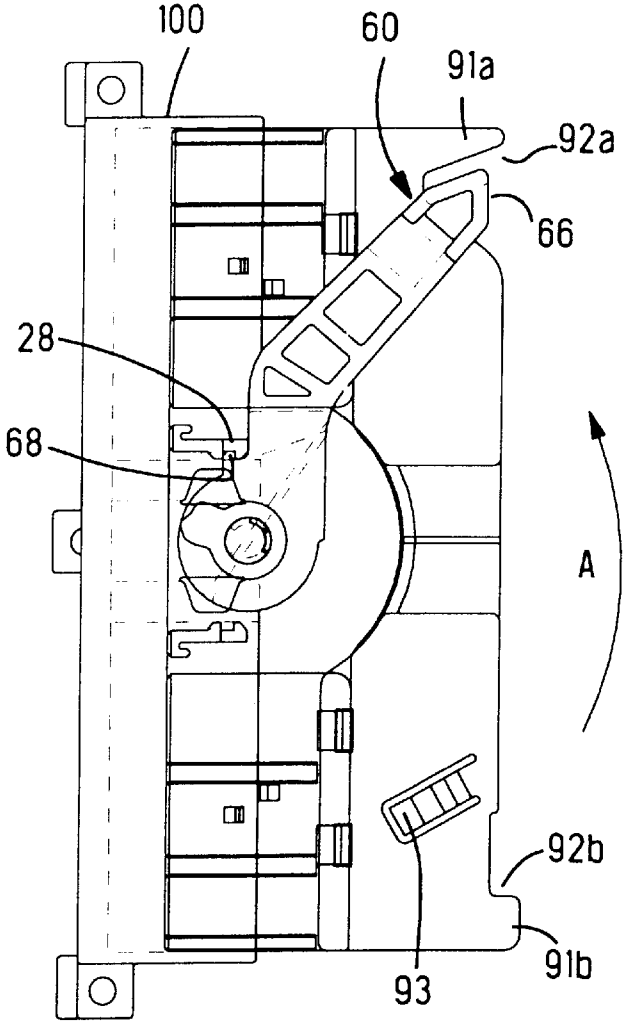
FIG. 12 is a plan view of the the lever in the provisional anchoring position.

FIGS. 12 and 13 are plan views which illustrate the pivoting of the lever 60 and the resulting engagement with a mating connector 100. FIG. 12 is a plan view which shows the lever 60 in the provisional anchoring position, and FIG. 13 is a plan view which shows the lever 60 in the final anchoring position.

The lever 60 attached to the housing body 10 as shown in FIG. 7 is first pivoted in the direction indicated by arrow A, so that the lever 60 is placed in the provisional anchoring position. Locking parts 68 on the lever 60 engage with locking parts 28 on the housing body 10 (see FIG. 3) so that the provisional anchoring state is maintained. The wire cover 40 has a side wall 91*a* which protrudes along one side. When the lever 60 is in the provisional anchoring state, the operating part 66 is positioned inside a recess 92*a* which is marked off by this side wall 91*a;* accordingly, there is no danger of the provisional anchoring state of the lever 60 being easily released as a result of interference of the operating part 66 with an outside member.

After the mating connector is tentatively attached with the lever 60 placed in the provisional anchoring position shown in FIG. 12, the mating connector can be engaged by releasing the engagement between the locking parts 68 and locking parts 28, and pivoting the lever 60 in the direction indicated by arrow B. When this pivoting is completed, the lever 60 is located in the position shown in FIG. 13, and is anchored by latches 93 disposed on the wire cover 40. In this position as well, the operating part 66 is positioned inside a recess 92*b* marked off by a side wall 91*b;* accordingly, interference from the outside is prevented.

A lever type connector constituting an embodiment of the present invention was described above. However, this embodiment does not limit the present invention; various modifications and alterations are possible. For example, in the lever type connector of the embodiment described above, the main body 20 and wire cover 40 which made up the housing body 10 were formed as separate parts; however, it would also be possible to form both of these parts as an integral unit. Furthermore, in the embodiment described above, grooves were formed in the lever, and ribs engaging with these grooves were formed on the housing body; however, it would also be possible to reverse this arrangement so that ribs are formed on the lever and grooves are formed in the housing body. Moreover, in the embodiment described above, the connector was constructed so that when the engagement between the lever 60 and the inclined parts 42 was released and arms 65 underwent elastic recovery inward, the arms 65 contacted the upper surfaces of the posts 22. However, it would also be possible to construct the connector so that the openings 62 are engaged with the posts 22 at the same time that the engagement between the lever 60 and the inclined parts 42 is released. Furthermore, it would also be possible to form ribs on the upper surfaces of the posts 22 which engage with the grooves 63 in the arms 65 when the arms 65 contact the upper surfaces of the posts 22, thus guiding the lever 60 until the openings 62 are aligned with the posts 22. Moreover, in the embodiment described above, openings 62 were formed in the lever 60 and posts 22 were formed on the housing body; however, it would also be possible to reverse this arrangement so that posts are formed on the lever and openings are formed in the housing body.

The lever type connector of the present invention has a guide means which causes the arms of the lever to engage with the housing, and which guides the arms to positions directly above the posts or openings of the housing body while elastically spreading the arms outward, when the lever is mounted on the housing body. Furthermore, the lever type connector of the present invention is constructed so that when the lever reaches a point where the arms of the lever are directly above the posts or openings of the housing body, the engagement between the housing and the lever is released, and the openings or posts of the lever are moved to positions in the vicinity of the posts or openings of the housing body. Accordingly, attachment of the lever to the housing body is facilitated, and can be performed quickly and securely, so that the working efficiency of connector assembly is improved.

What is claimed is:

1. A lever-operated electrical connector, comprising a housing having opposing walls;

an operating lever having parallel arms connected at outer ends thereof;

first pivot members comprising posts on outer surfaces of the opposing walls and second pivot members comprising openings extending from inner sections of the parallel arms;

biasing surfaces on the housing for biasing the inner section of the parallel arms outwardly as movement of the operating lever results in movement of the inner sections along the biasing surfaces and the opposing walls; and co-operable rib and groove guide means comprising first guide members on the biasing surfaces and second guide members on the inner sections guiding the inner sections along the biasing surfaces an the opposing walls to align the pivot members, permitting the inner sections to move inwardly to bring the first and second pivot members into engagement, whereby the operating lever can pivotally move relative to the housing.

2. A lever-operated electrical connector as claimed in claim 1, wherein the pivot members comprise posts on the outer surfaces of the opposing walls and openings extending through the inner sections of the parallel arms.

3. A lever-operated electrical connector as claimed in claim 1, wherein the biasing surfaces define inclined surfaces.

4. A lever-operated electrical connector as claimed in claim 3, wherein the first guide members comprise ribs extending along said inclined surfaces in alignment with the first pivot members on the outer surfaces of the opposing walls of the housing and the second guide members comprise grooves engagable with the ribs on inner surface of the inner sections of the parallel arms in alignment with the pivot members on the inner sections of the parallel arms.

5. A lever-operated electrical connector as claimed in claim 3, wherein shoulders are located at inner ends of the inclined surfaces, and stepped sections of the parallel arms are disposed adjacent the shoulders.

6. A lever-operated electrical connector as claimed in claim 5, wherein the shoulders have an arcuate shape.

7. A lever-operated electrical connector as claimed in claim 2, wherein the posts have recesses and the openings have projections which are aligned when the pivot members are vertically aligned and the projections move through the recesses when the inner sections move inwardly thereby fastening the operating lever to the housing.

8. A lever-operated electrical connector as claimed in claim 7, wherein the posts have grooves in which the projections of the openings are disposed.

9. A lever-operated electrical connector as claimed in claim 1, wherein first latching members are provided by the housing and the operating lever to maintain the operating lever in a non-operated position, and second latching members are provided by the housing and the operating lever to maintain the operating lever in an operated position.

10. A lever-operated electrical connector as claimed in claim 1, wherein the housing comprises a main body and a wire cover latchably mounted to each other.

11. A lever-operated electrical connector comprising a housing having and upper wall and a lower wall;

pivot posts extending upwardly from the upper wall and the lower wall midway thereof;

an operating lever having an upper arm and a lower arm, an operating member connecting the upper arm and the lower arm together at outer ends thereof;

inner sections of the upper arm and the lower arm having openings;

biasing surfaces on the housing for biasing the inner sections of the upper arm and the lower arm outwardly as the operating lever moves the inner section along the upper wall and the lower wall; and guide ribs on the biasing surfaces and guide grooves on the inner sections guiding the inner sections to align the openings of the inner sections with the pivot posts whereupon the inner sections move inwardly to dispose the pivot posts in the openings whereby the operating lever can move relative to the housing.

* * * * *